US008469619B1

(12) United States Patent
Lewis et al.

(10) Patent No.: US 8,469,619 B1
(45) Date of Patent: Jun. 25, 2013

(54) CLEANING GLOVE ASSEMBLY

(76) Inventors: Larry D. Lewis, Spring Hill, FL (US); Vilma A. Lewis, Spring Hill, FL (US)

( * ) Notice: Subject to any disclaimer, the term of this patent is extended or adjusted under 35 U.S.C. 154(b) by 405 days.

(21) Appl. No.: 12/874,691

(22) Filed: Sep. 2, 2010

(51) Int. Cl.
*A46B 5/04* (2006.01)

(52) U.S. Cl.
USPC ..... 401/7

(58) Field of Classification Search
USPC ..... 401/6, 7; 15/227
See application file for complete search history.

(56) References Cited

U.S. PATENT DOCUMENTS

| | | | | | |
|---|---|---|---|---|---|
| 1,177,412 | A | * | 3/1916 | Hopkins | 239/529 |
| 2,061,219 | A | * | 11/1936 | Wright | 401/7 |
| 2,663,890 | A | * | 12/1953 | Sullins | 401/7 |
| 3,778,172 | A | | 12/1973 | Myren | |
| 3,883,897 | A | * | 5/1975 | Lefkowitz et al. | 2/161.6 |
| D268,968 | S | * | 5/1983 | Sami | D29/117.1 |
| 5,169,251 | A | | 12/1992 | Davis | |
| 5,441,355 | A | | 8/1995 | Moore | |
| 5,956,770 | A | | 9/1999 | Dennis | |
| 6,098,234 | A | | 8/2000 | Jackson, Jr. | |
| 6,513,998 | B1 | | 2/2003 | Barry | |
| 2005/0177965 | A1 | | 8/2005 | Edoh | |
| 2007/0192975 | A1 | | 8/2007 | Aseff | |

FOREIGN PATENT DOCUMENTS

| | | | |
|---|---|---|---|
| IT | MI20090141 | * | 4/2009 |

* cited by examiner

*Primary Examiner* — Huyen Le

(57) ABSTRACT

A cleaning glove assembly includes a hand covering that with a palm covering and a back hand covering attached together to form a sleeve having a hand receiving opening. A plurality of finger sleeves is attached to the back hand and palm coverings distal to the hand receiving opening. The hand covering is configured to completely cover a hand positioned within the hand covering. A chamber is attached to and covers the palm covering and a lower surface of each of the sleeves. An outer surface of the chamber has a plurality of apertures extending therethrough and into an interior of the chamber. A cleansing fluid is positionable in the chamber and ejectable outwardly through the apertures.

5 Claims, 6 Drawing Sheets

CLEANING GLOVE ASSEMBLY

BACKGROUND OF THE DISCLOSURE

Field of the Disclosure

The disclosure relates to cleaning gloves and more particularly pertains to a new cleaning glove for assisting a person in cleaning a surface and which contains a cleaning fluid.

SUMMARY OF THE DISCLOSURE

An embodiment of the disclosure meets the needs presented above by generally comprising a hand covering that includes a palm covering and a back hand covering attached together to form a sleeve having a hand receiving opening. A plurality of finger sleeves is attached to the back hand and palm coverings distal to the hand receiving opening. The hand covering is configured to completely cover a hand positioned within the hand covering. A chamber is attached to and covers the palm covering and a lower surface of each of the sleeves. An outer surface of the chamber has a plurality of apertures extending therethrough and into an interior of the chamber. A cleansing fluid is positionable in the chamber and ejectable outwardly through the apertures.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
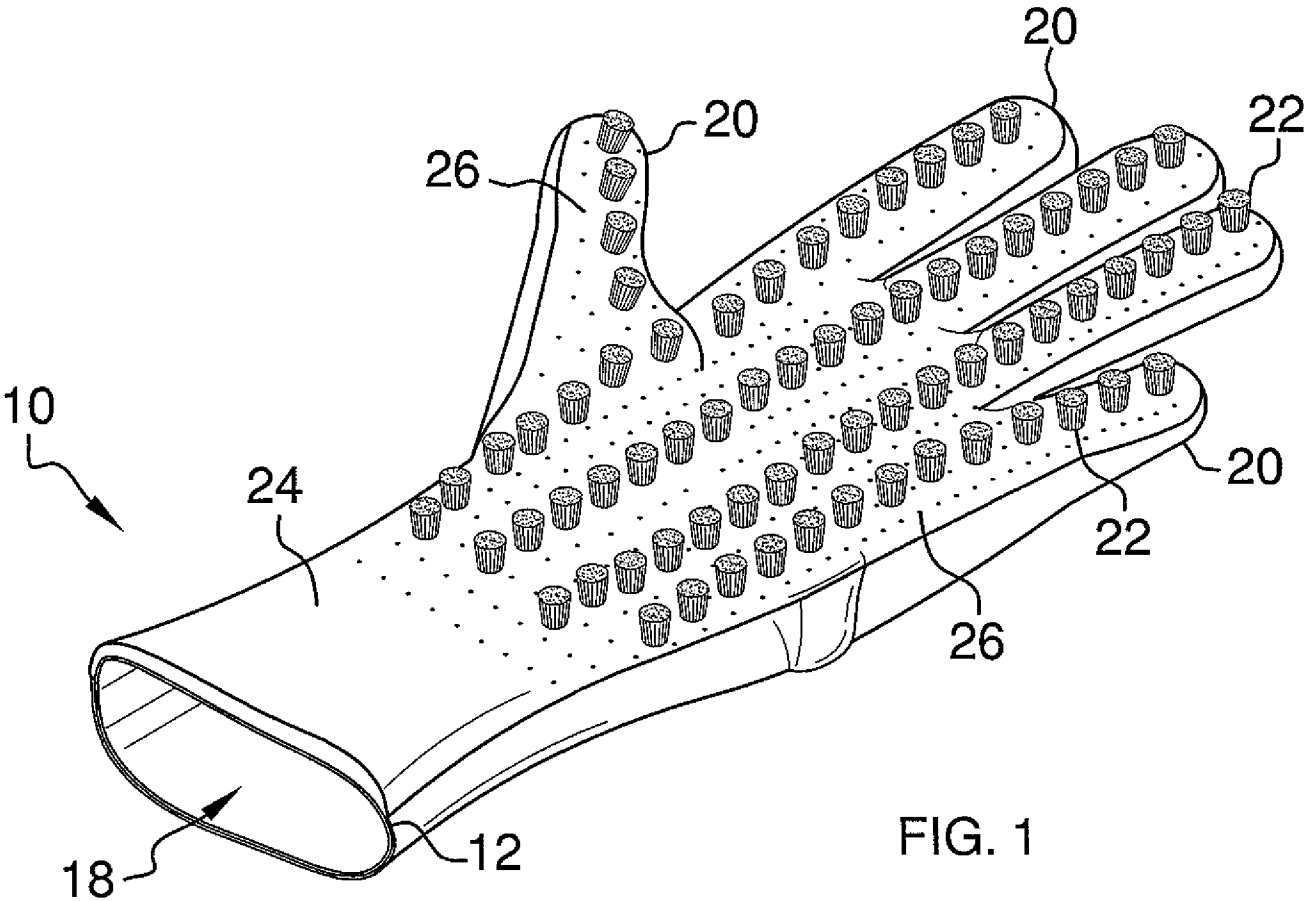
FIG. 1 is a bottom perspective view of a cleaning glove assembly according to an embodiment of the disclosure.

With reference now to the drawings, and in particular to FIGS. 1 through 6 thereof, a new cleaning glove embodying the principles and concepts of an embodiment of the disclosure and generally designated by the reference numeral 10 will be described.

Figure 2:
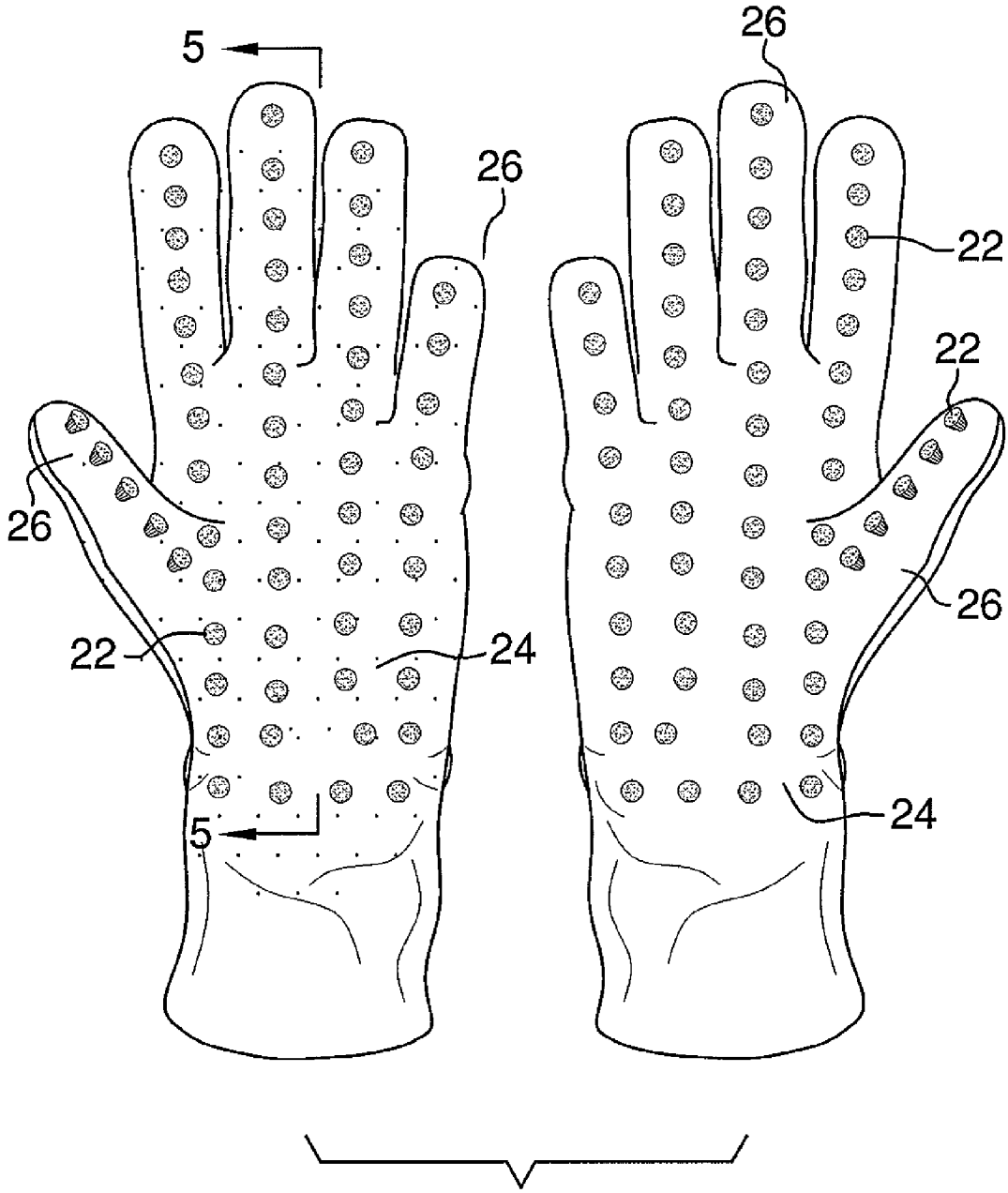
FIG. 2 is a bottom view of an embodiment of the disclosure.
Figure 3:
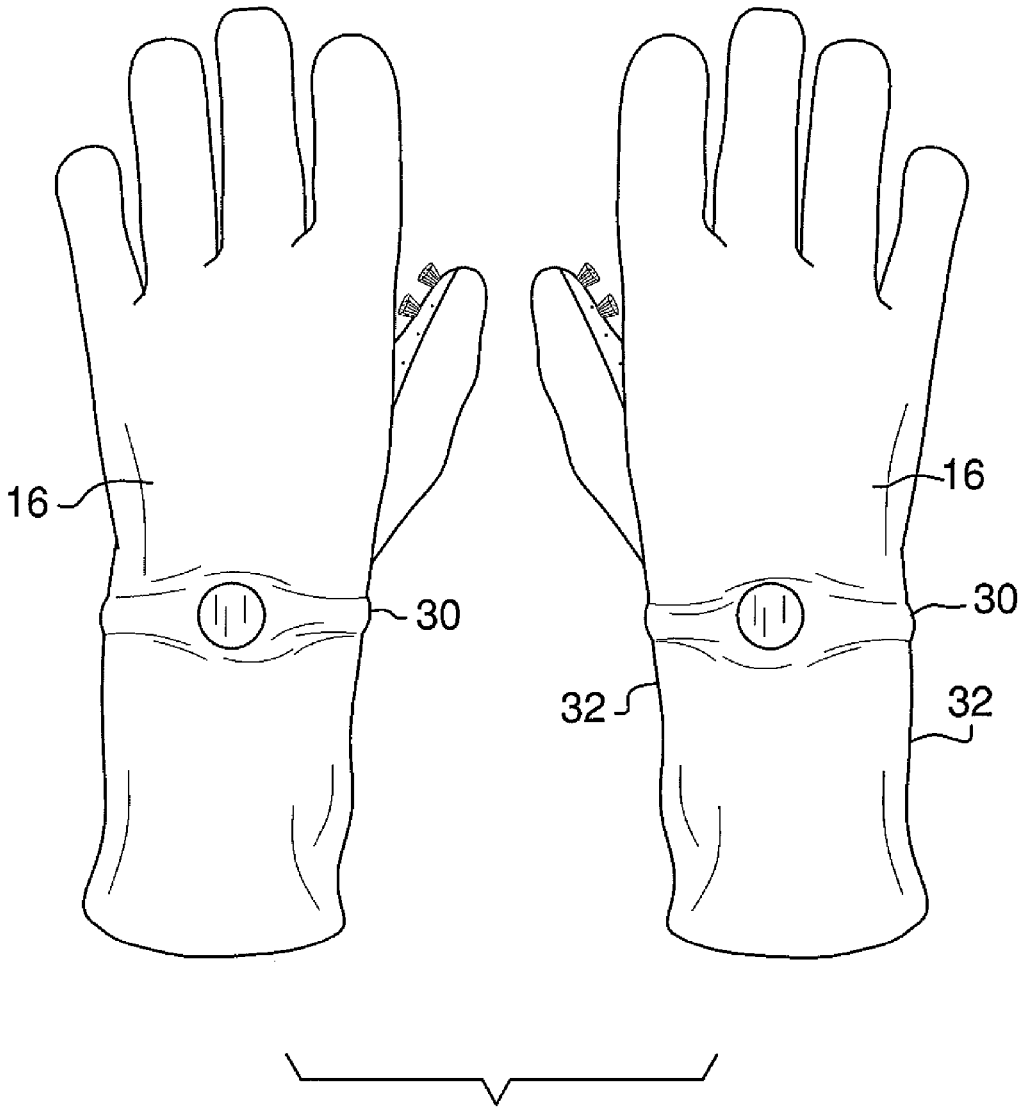
FIG. 3 is a top view of an embodiment of the disclosure.
Figure 4:
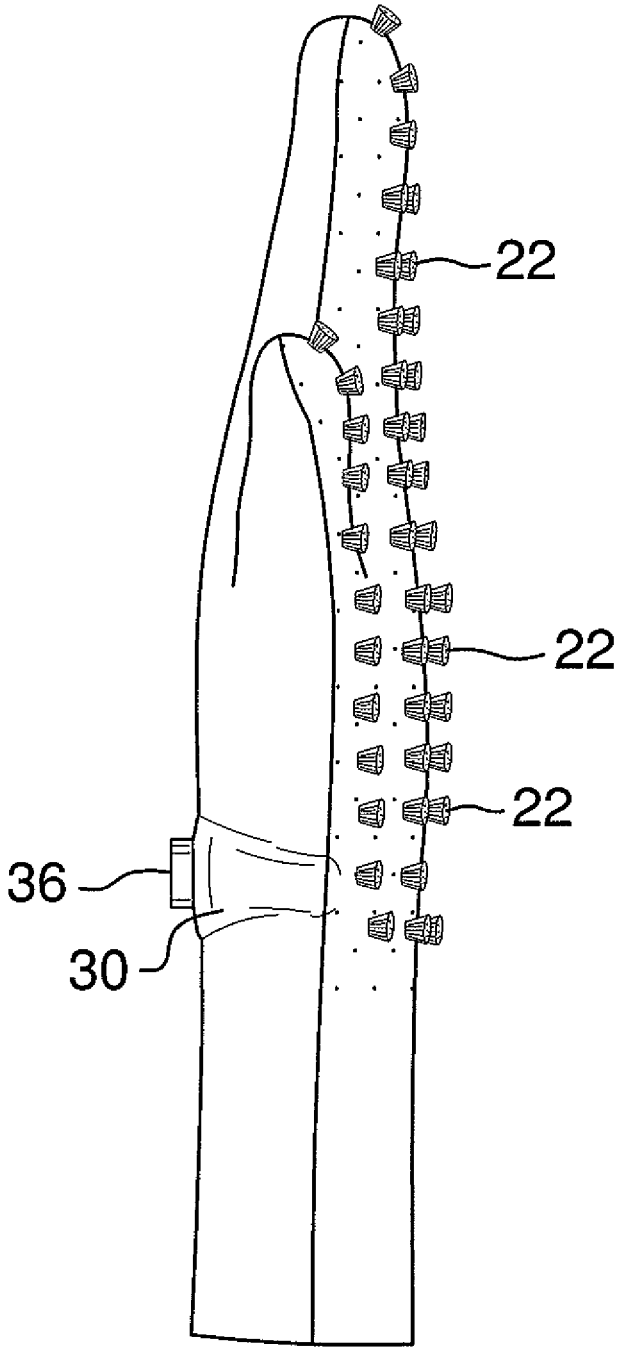
FIG. 4 is a side view of an embodiment of the disclosure.
Figure 5:
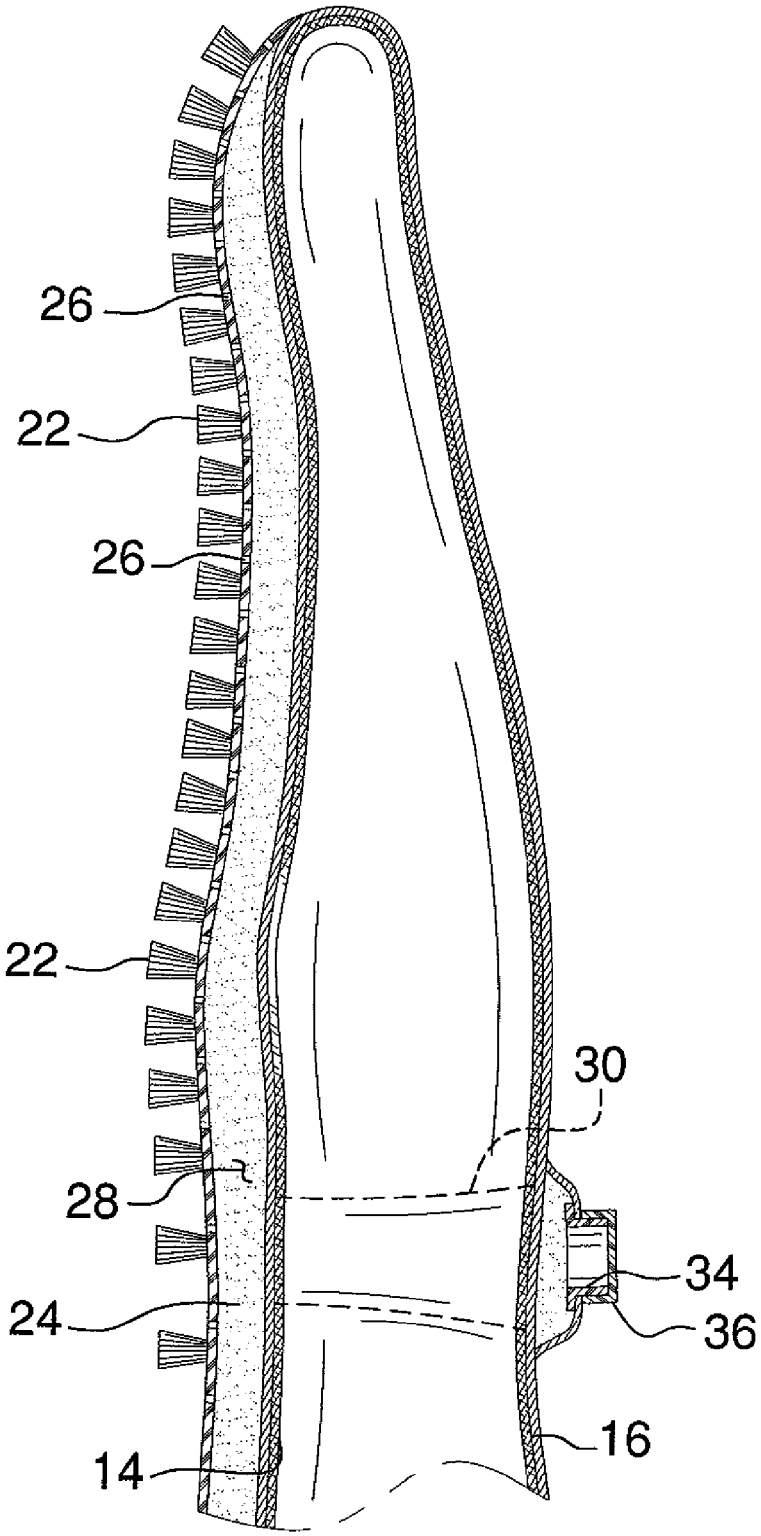
FIG. 5 is a cross-sectional view of an embodiment of the disclosure taken along line 5-5 of FIG. 2.

As best illustrated in FIGS. 1 through 6, the cleaning glove assembly 10 generally comprises a hand covering 12 that includes a palm covering 14 and a back hand covering 16 attached together to form a sleeve having a hand receiving opening 18. A plurality of finger sleeves 20 is attached to the back hand 16 and palm 14 coverings distal to the hand receiving opening 18. The hand covering 12 is configured to completely cover a hand positioned within the hand covering 12. The hand covering may comprise an elastomeric material. As shown in FIG. 2, the hand covering 12 may includes a pair of hand coverings with one configured for a left hand and the other for a right hand.

A chamber 24 is attached to and covers the palm covering and lower surface of each of the sleeves. Alternatively the chamber 24 may be mounted within the hand covering as, structurally, either configuration would form a same overall structure if the chamber 24 and the hand covering 12 are fused together to define a single and continuous structure. An outer surface of the chambers has a plurality of apertures 26 extending therethrough and into the chamber 24. A cleansing fluid 28 is positionable in the chamber 24 and ejectable outwardly through the apertures 26 as the hand covering 12 is used for cleaning a surface.

Figure 6:
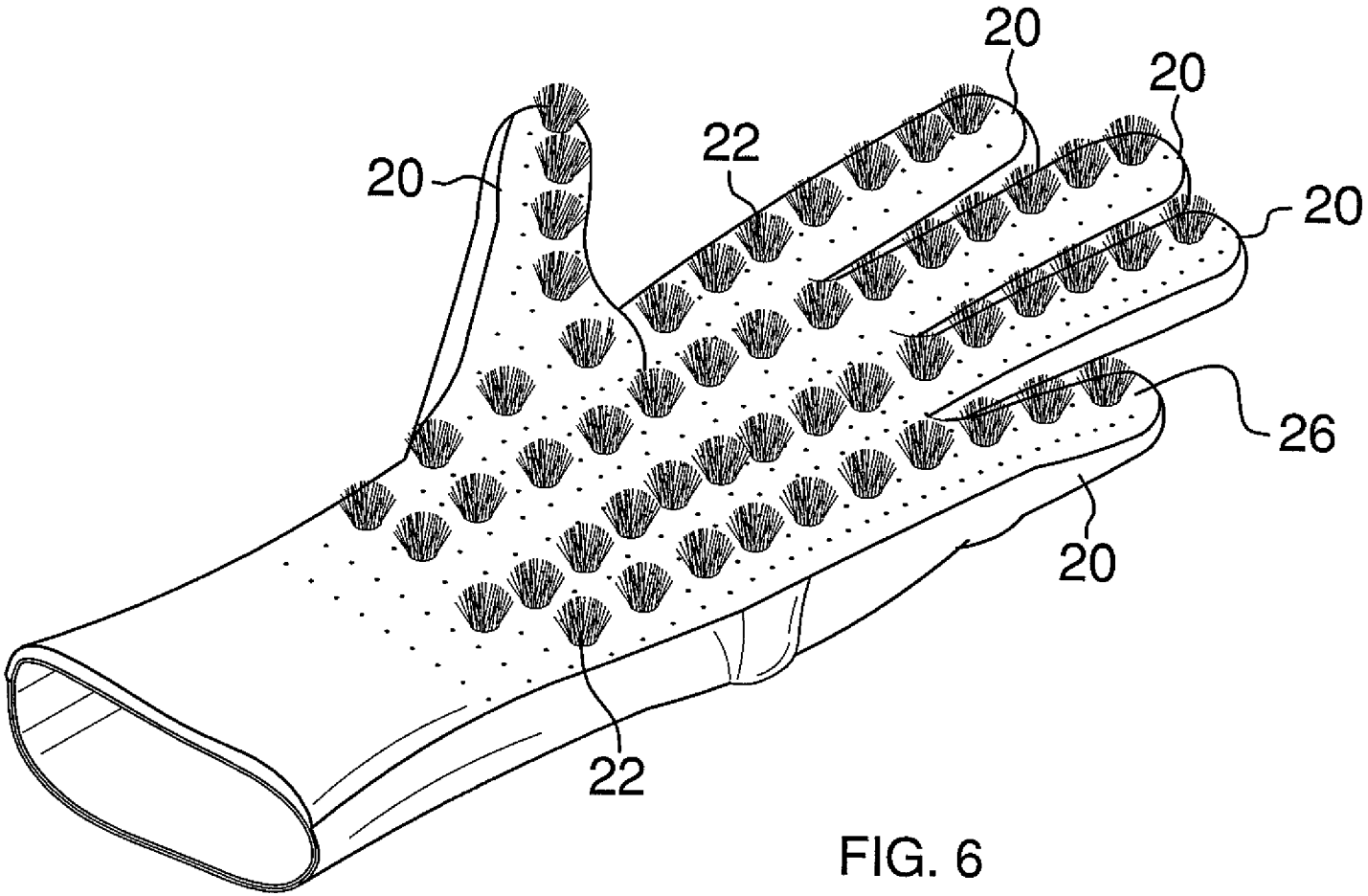
FIG. 6 is a bottom perspective view of an embodiment of the disclosure.

A plurality of bristles 22 is attached to the outer surface of the chamber 24 and positioned opposite the palm covering 14 and the sleeves 20. As shown in FIGS. 1 and 6, the bristles 22 may be densely packed as shown in FIG. 1 or loosely packed as shown in FIG. 6. The bristles 22 may also either be relatively rigid or relatively soft.

A fill channel 30 is mounted on the hand covering 12 and extends from the back hand covering 16 to the chamber 24. The fill channel 30 extends from a central area of the back hand covering 16 and along each of a pair of lateral sides 32 of the hand covering 12. The fill channel 30 is resiliently compressible and cleansing fluid 28 is forced into the chamber 24 when the fill channel 30 is compressed. The positioning of the fill channel 30 will allow a person to flex their hand and/or wrist to cause the fill channel 30 to be compressed. Alternatively, the fill channel 30 can be compressed from the outside of the channel 30. A filling port 34 is fluidly coupled to the fill channel 30. The cleansing fluid 28 may be poured into the fill channel 30 through the filling port 34. A covering 36 removably closes the filling port 34.

In use, the channel 30 is filled with a cleansing fluid 24 so that it may enter the chamber 24 as a person cleans a surface with the bristles and the cleansing fluid 28 is ejected outwardly of the apertures 26. The cleansing fluid 28 is used for cleaning the surface and the chamber 28 may be re-filled as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A cleaning glove assembly comprising:

a hand covering including a palm covering and a back hand covering attached together to form a sleeve having a hand receiving opening, a plurality of finger sleeves being attached to said back hand and palm coverings distal to said hand receiving opening, said hand covering being configured to completely cover a hand positioned within said hand covering; and a chamber being attached to and covering said palm covering and a lower surface of each of said sleeves, an outer surface of said chamber having a plurality of apertures extending therethrough and into an interior of said chamber, wherein a cleansing fluid is positionable in said chamber and ejectable outwardly through said apertures; and wherein said fill channel extends from a central area of said back hand covering and along each of a pair of lateral sides of said hand covering, said fill channel being resiliently compressible, wherein cleansing fluid is forced into said chamber when said fill channel is compressed.

2. The assembly according to claim 1, further including a plurality of bristles being attached to an outer surface of said chamber.

3. The assembly according to claim 2, further including a fill channel being mounted on said hand coverings and extending from said back hand covering to said chamber, said fill channel being fluidly coupled to said chamber, a filling port being fluidly coupled to said fill channel, wherein the cleansing fluid may be poured into said fill channel through said filling port, a covering removably closing said filling port.

4. The assembly according to claim 1, further including a fill channel being mounted on said hand coverings and extending from said back hand covering to said chamber, said fill channel being fluidly coupled to said chamber, a filling port being fluidly coupled to said fill channel, wherein the cleansing fluid may be poured into said fill channel through said filling port, a covering removably closing said filling port.

5. A cleaning glove assembly comprising:

a hand covering including a palm covering and a back hand covering attached together to form a sleeve having a hand receiving opening, a plurality of finger sleeves being attached to said back hand and palm coverings distal to said hand receiving opening, said hand covering being configured to completely cover a hand positioned within said hand covering;

a chamber being attached to and covering said palm covering and a lower surface of each of said sleeves, an outer surface of said chamber having a plurality of apertures extending therethrough and into an interior of said chamber, wherein a cleansing fluid is positionable in said chamber and ejectable outwardly through said apertures;

a plurality of bristles being attached to an outer surface of said chamber;

a fill channel being mounted on said hand coverings and extending from said back hand covering to said chamber, said fill channel extending from a central area of said back hand covering and along each of a pair of lateral sides of said hand covering, said fill channel being resiliently compressible, wherein cleansing fluid is forced into said chamber when said fill channel is compressed; and a filling port being fluidly coupled to said fill channel, wherein the cleansing fluid may be poured into said fill channel through said filling port, a covering removably closing said filling port.

* * * * *